United States Patent [19]

Rosenbaum

[11] 4,037,358

[45] July 26, 1977

[54] MODEL AIRPLANE DRIVE AND CONTROL SYSTEM

[76] Inventor: Phillip Rosenbaum, 113 Nurmi, Fort Lauderdale, Fla. 33301

[21] Appl. No.: 627,522

[22] Filed: Oct. 31, 1975

[51] Int. Cl.[2] ..... A63H 30/02

[52] U.S. Cl. ..... 46/253; 35/12 L; 40/30; 46/202; 46/257

[58] Field of Search ..... 40/30, 126 R, 128, 139; 46/13, 126, 240, 216, 253, 257, 258, 259, 260, 261, 78, 262, 202; 35/12 L; 272/22, 23, 24, 31 A, 31 R; 273/105.2

[56] References Cited

U.S. PATENT DOCUMENTS

| | | | |
|---|---|---|---|
| 1,385,634 | 7/1921 | Marshall | 272/31 A |
| 2,168,384 | 8/1939 | Barry | 40/126 R X |
| 2,478,695 | 8/1949 | Hinton | 46/77 |
| 2,595,650 | 5/1952 | Eppler | 46/77 |
| 2,793,860 | 5/1957 | DeCrescenzo | 46/202 X |
| 3,099,104 | 7/1963 | Rudolf | 46/240 |
| 3,396,487 | 8/1968 | Risser | 46/40 |
| 3,451,161 | 6/1969 | Lemelson | 46/241 |

FOREIGN PATENT DOCUMENTS

| | | | |
|---|---|---|---|
| 785,039 | 5/1935 | France | 35/12 L |
| 832,876 | 7/1938 | France | 272/31 A |

*Primary Examiner*—F. Barry Shay
*Attorney, Agent, or Firm*—Malin & Haley

[57] ABSTRACT

A toy or model airplane including a drive and attitude control system for simulating actual aircraft maneuvers including taxiing, take-off, climb, descent, turns and landing. The system includes a toy airplane suspended by a tether from a moveable platform magnetically fixed or coupled to the lower surface of a false ceiling. A drive vehicle supported on the upper surface of the false ceiling is magnetically coupled to the lower platform to provide forward velocity to the platform and the tethered toy airplane. The moveable suspended platform includes a drive motor which is coupled to the airplane tether to allow raising or lowering the tether airplane for altitude change simulation. The toy airplane fuselage houses additional drive motors for simulating attitude changes including roll and pitch maneuvers. In an alternate embodiment, the tethered airplane may be supported from a track-like mechanism coupled to a conventional ceiling. The system includes a control console for providing power to the various drive motors to achieve actual flight simulation of the toy airplane.

6 Claims, 7 Drawing Figures

MODEL AIRPLANE DRIVE AND CONTROL SYSTEM

BACKGROUND OF THE INVENTION

This invention relates generally to a toy or model aircraft drive and flight simulating control system which includes a moveable platform suspended from a conventional or false ceiling attached to a tethered toy airplane which may also be raised or lowered vertically to simulate climb and descent. The aircraft body houses pitch and roll control motors to provide simulation of actual flight attitudes, such as banking, climbing, descending, landing and take-off.

In the prior art, toy aircraft have been shown which have self-contained propulsion systems for actually engaging in flight which generally restricts indoor usage. Other toy aircraft which are ground supported on rotating arms or the like fail to achieve the realism of actual flight. With the exception of the self-propelled model aircraft, the prior art does not show a device which truly provides a three dimensional control and drive of a model airplane to more realistically simulate actual flight conditions of an aircraft.

The instant invention comprises an inclusive system which provides forward motion for a model airplane in any direction and pitch and roll maneuvers, the model aircraft attached to and suspended from a vertical tether which is coupled to a moveable platform magnetically suspended on the underside of a false ceiling to a drive vehicle supported on the upper surface of the false ceiling. The drive vehicle is magnetically coupled by permanent magnets to the moveable platform, which includes a tether reel drive motor for vertically lowering or raising the aircraft, for altitude control. The tether houses electrical conductors from a control console to provide electrical power to a pair of motors housed within the model aircraft fuselage to provide changes in roll and pitch of the aircraft while suspended from the tether. The drive vehicle mounted on the top surface of the false ceiling has steerable wheels and a wheel drive electric motor. The moveable platform on the bottom surface of the false ceiling has ball bearing type wheels such that the platform may be moved in any direction about the false ceiling by movement with the drive vehicle. Thus utilizing the instant model aircraft drive and control system, an operator may simulate all aircraft attitudes including take-off and landing plus a variety of standard aerobatic flight maneuvers to provide more realism with the use of the toy. The system may also be utilized for teaching aircraft flight maneuvers as a flight simulator.

BRIEF DESCRIPTION OF THE INVENTION

A model or toy aircraft flight drive and control system for propelling and simulating aircraft maneuvers comprising a model airplane, said model airplane fuselage housing a pair of drive motors for positioning the attitude of the aircraft in pitch and roll, a false ceiling, a steerable drive vehicle having an electric motor supported on the upper side of said false ceiling, a moveable platform disposed on the bottom surface of said false ceiling magnetically coupled to said drive vehicle, a tether connected to said moveable platform and said aircraft for vertically tethering the aircraft, a means attached to the moveable plateform and the tether for raising and lowering the tether for aircraft altitude control.

The model aircraft structure itself includes a nonrotating fixed central fuselage section disposed forward and aft fuselage sections which are capable of rotating in unison together on a common shaft about the nonrotating central fuselage section. This fixed central section houses roll and pitch drive motors for positioning the entire three section fuselage relative to its longitudinal axis to simulate various roll and pitch maneuvers. A flight control panel includes controls for providing the model airplane with variable speed forward motion, variable speed altitude changes, flight attitude changes and directional change capability. The flight control panel may be constructed with a single stick, throttle and rudder pedals as in actual aircraft or with up-down, pitch-roll and forward movement control throttles and alternate stick arrangement to replace rudder pedals for directional control.

The model or toy airplane is thus capable of taxiing, taking off, landing, climbing, diving, straight and level flight, inverted flight, right and left banks, rolls, and various two dimensional flight paths describing sine waves, parabolic and hyperbolic patterns and most standard aerobatic maneuvers. The smoothness of the flight attitude and profile will be dependent upon the skill and coordination of the operator. An auxiliary electrical system may be utilized to have additional accessories such as lights, retractable wheels, wing flaps, etc. on the aircraft which may be by an electric motor activated by toggle switches on the flight control panel.

It is an object of this invention to provide a model aircraft flight control system for simulating all conventional flight attitudes for a real aircraft including take-off, landing, various flight positions and basic standard aerobatic maneuvers.

It is another object of this invention to provide a model aircraft propulsion system in which the model aircraft is suspended from a ceiling or the like and is tethered with the tether being controlled vertically for movement up and down.

And still yet another object of this invention is to provide a model aircraft which is suspended and tethered from a moveable vehicle suspended from a ceiling which may be driven about the ceiling surface simulating various flight attitudes including take-off and landing of the airplane.

But still yet another object of this invention is to provide a model aircraft drive and control system in which the aircraft is controlled to assume various flight attitudes including angles of bank, rolls and pitch of the vehicle while being suspended from a tether which is driven on a vehicle suspended from a ceiling or the like.

But still yet another object of this invention is to provide a model aircraft flight control system for use indoors which allows an operator to simultaneously provide forward motion, altitude control and aircraft flight attitude control such that the aircraft simulates flying without actually having to be flown.

In accordance with these and other objects which will be apparent hereinafter, the instant invention will now be described with particular reference to the accompnaying drawings.

PREFERRED EMBODIMENT OF THE INVENTION

Figure 1:
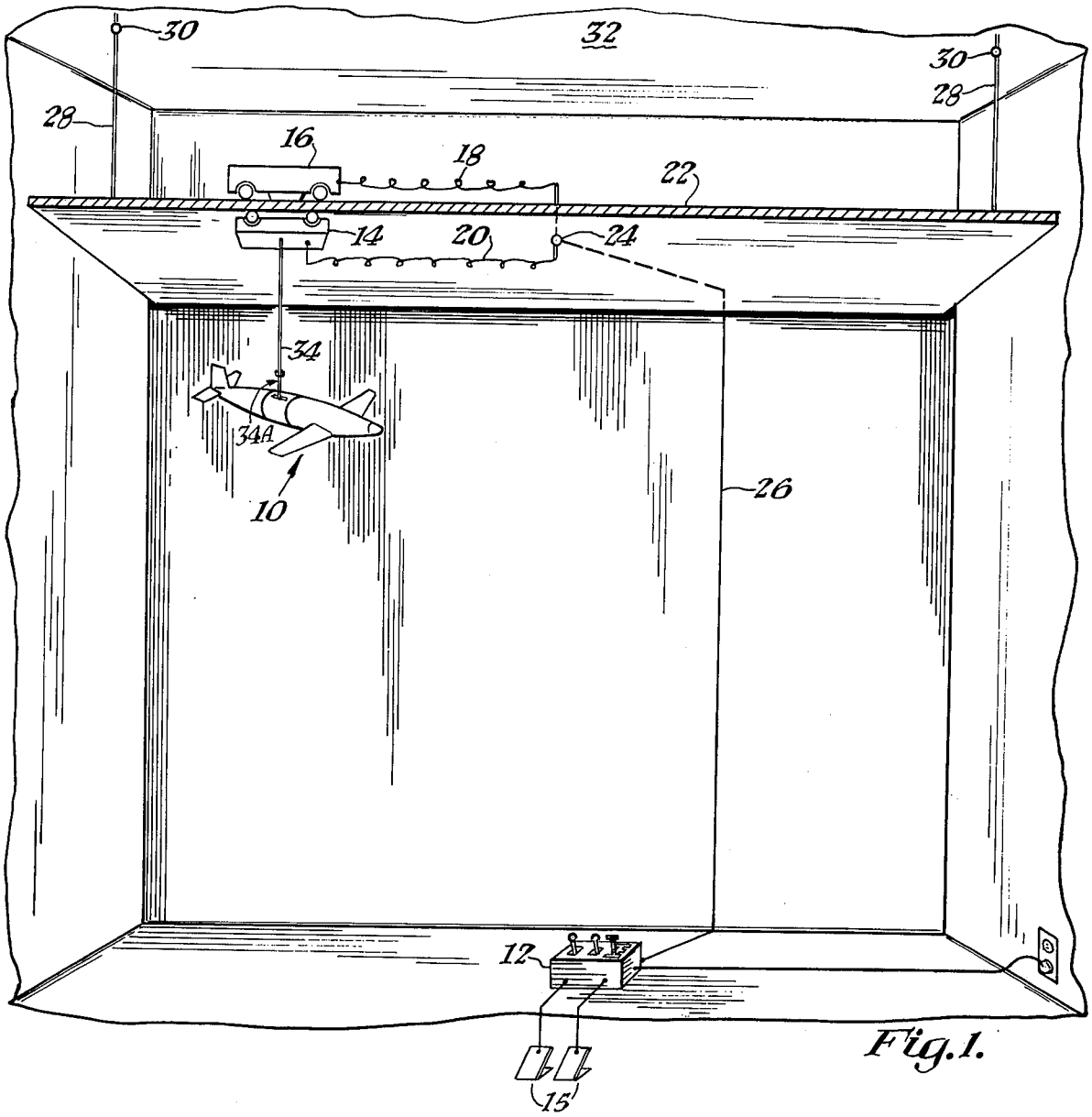
FIG. 1 shows a perspective view of the instant invention as disposed in a conventional room.

Referring now to FIG. 1, a model aircraft shown at 10 is suspended from a flexible tether cord 34 which is moveably coupled to a vehicle 14 magnetically suspended on the bottom side of a false ceiling 22 supported by vertical supports 28 from a conventional ceiling 32 with fasteners 30. A motor driven, steerable vehicle 16 is supported on the upper surface of false ceiling 22. Steerable vehicle 16 is coupled to a flight control panel and power source 12 by conductor 26 which contains power and control conductors going to the motor driven vehicle 16 and the moveable supporting platform 14 by extendable conductors 18 and 20 which are connected to the false ceiling 22 to permit the joined movement of the drive vehicle 16 and moveable platform 14 about the false ceiling. The flight control panel 12 may be connected to conventional power source such as 115 Volt AC commonly found in home use.

Moveable platform 14 and the drive vehicle 16 are magnetically coupled together through the false ceiling 22 by permanent magnets fixed on vehicle 16 and platform 14.

The flight control panel 12 has a plurality of variable current control switches which control the power to a motor fixed on the drive vehicle 16 which propells the vehicle about the upper surface of the false ceiling 22. Vehicle 16 also includes motor actuated steerable wheels which receives power and control signals from the flight control panel 12 via the rudder pedal input so that the direction of movement of the vehicle 16 may be selected by one operating the flight control panel 12. The moveable platform 14 contains a drive motor and tether reel which is connected to tether 34 for raising and lowering the tether and therefore the aircraft 10 to provide for altitude control of the aircraft. Disposed within the aircraft body are additional drive motors which allow for pitch and roll movement of the aircraft fuselage to simulate flight attitudes of an actual airplane. The operation of each element is described in greater detail below.

Figure 2:
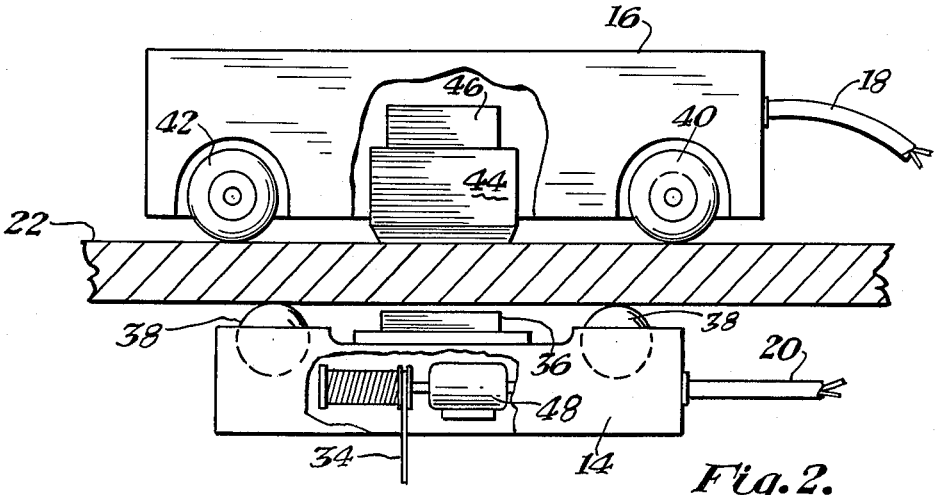
FIG. 2 shows a side elevational view partially in cross-section of the drive and suspension vehicles utilized in the instant invention.

Referring now to FIG. 2, the drive vehicle 16 is shown having drive wheels and steerable wheels 42 which are connected to a drive motor 46 which has appropriate gearing to provide forward movement of the vehicle 16 and movement of the wheels 42 upon command received through conductor 18 from the flight control panel 12 (shown in FIG. 1). Vehicle 16 also includes a permanent magnet 44 disposed adjacent its underside which magnetically couples a moveable platform 14 having a permanent magnet 36 so that the moveable platform is suspended on the underside of the false ceiling 22. The moveable platform 14 also includes a plurality of ball and socket wheels 38 which allow the platform to be moved in any direction about the underside of false ceiling 22. Also disposed within platform 14 is a motor 48 and a reel connected thereto which is coupled to tether 34 such that driving motor 48 will cause the tether and an aircraft connected thereto to be raised or lowered, depending upon the direction of rotation of the motor. The command signals for the motor and the power are received through conductor 20 which likewise contains a control conductor which is received through the tethered cord 34 into the aircraft and is described below. The control tether allows for pitch and roll control movements. Thus, the drive vehicle 16 is propelled about the upper surface of the false ceiling 22 in a direction and speed selected by the operator at the flight control panel 12. The moveable platform 14 being magnetically coupled to drive vehicle 16 thus moves with and follows the drive vehicle.

Figure 3:
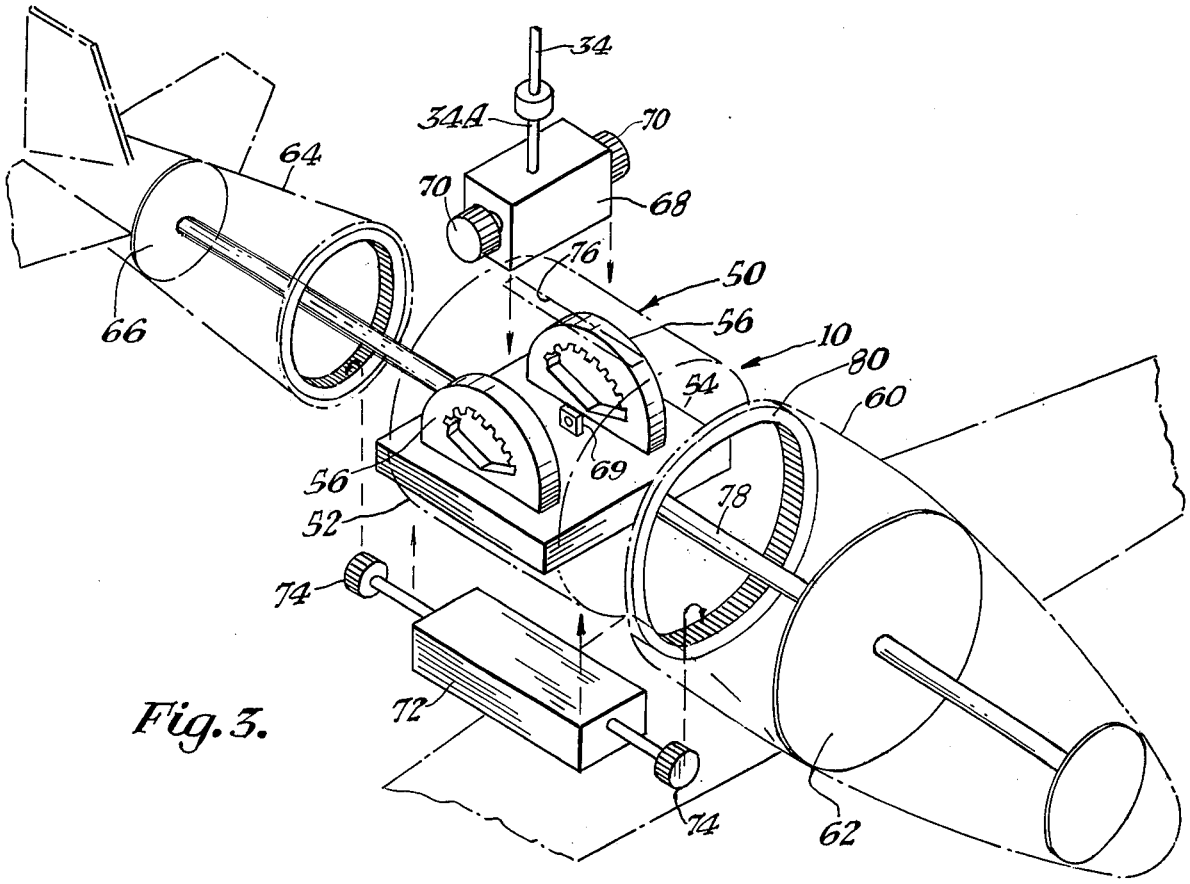
FIG. 3 shows a perspective, exploded view of the model or toy aircraft and its drive mechanism utilized in the instant invention.

FIG. 3 shows a model or toy aircraft utilized with the instant invention which is suspended and coupled to the tethering cord 34 which contains power and control conductors to a pitch control motor 68 and a roll control motor 72. The aircraft includes a three piece fuselage section having a front section 60 and center section 50 and a rear fuselage section 64. The pitch control motor 68 is connected to a pair of circular pinions 70 on each side which engage segmented ring gears 56 attached to a center fuselage platform 54 contained within the center fuselage section 52. The center of gravity of the entire model aircraft 10 is selected so that the forward and rear sections are balanced through the axis of the gears 70. The tether tube 34A is attached to platform 54 by fulcrum pin 71 which passes through attachment lugs 69 and the bottom of tether tube 34A. Driving the motor 68 and the pinions 70 in either direction will cause the entire fuselage to assume a nose-up or nose-down attitude which may be incrementally controlled by an operator through a particular positioning of the control sticks on the flight control panel 12 which sends the power and signals through the tethered cord 34 into the motor 68. The aircraft will hold the particular pitch position selected unitl the motor 68 is driven to reposition the pitch attitude of the entire aircraft.

To provide a simulated roll attitude which causes the forward fuselage including the wings and the rear fuselage including the tail to rotate about the longitudinal axis shaft 78, a roll control motor 72 is connected beneath platform 54 to a pair of circular gears 74 which engage gears 80. The shaft 78 is connected moveably to platform 54 through an aperture or guide such that the shaft freely rotates relative to platform 54. Power supplied to motor 72 through a conductor (not shown) which is received through the tether 34 will cause the motor 72 to rotate gear 74 (either direction) which rotates gears 80 and shaft 78. Shaft 78 is rigidly coupled to the forward fuselage section 60 by a pair of supporting discs 62 and into the rear fuselage section by supporting disc 66. Again as with the pitch control, the roll attitude of the aircraft may then be changed or moved by the operator through the flight control panel 12 (FIG. 1) which includes a control stick and current control to provide power and directional control to motor 72 such that the operator may then change the position of the wings and tail of the aircraft, giving it the appearance of being in a banking angle. The center fuselage section 50 also includes a slot 76 for receiving the tether 34 which is coupled to the auxiliary vehicle 14 shown in FIG. 2. This slot 76 allows the tether 34 and electric motor 68 to remain always vertical while the model aircraft 10 is maneuvered from level flight through various changes and combinations of pitch and roll configurations.

Figure 4:
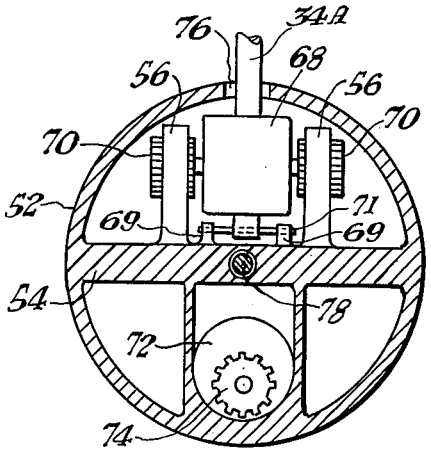
FIG. 4 shows a front elevational view in cross-section of the pitch and roll drive mechanism utilized in the toy or model aircraft in the instant invention.

FIG. 4 shows the center fuselage outer structure 52 and a center platform 54 connected thereto which supports ring gear segments 56 mounted on top of the center platform 54. Connected to the gears 56 are pinions 70 which are connected to the pitch drive motor 68. Disposed beneath the center platform 54 is a roll control motor 72 and the circular gears 74. The aperture through platform 54 receives the longitudinal shaft 78 (shown in FIG. 3) and the gear 80 which is connected to the circular gear 74 for driving the forward and rear fuselage portions into the particular desired roll attitude relative to the center platform.

Referring back to FIG. 1, the model airplane 10 may be driven and moved in all three planes in such a manner to provide simulation of the aircraft attitude to realistically simulate actual aircraft motion and attitudes. Thus, the aircraft can be made to taxi on the ground, simulate take-offs, simulate flight maneuvers (pitch and roll control), landings, and altitude changes and basic aerobatic maneuvers. Thus, in a typical maneuver, the flight control box 12 is utilized such that the aircraft tether cord would be reeled out so that the aircraft is in contact with the floor. Power is then applied to drive vehicle 16 in a forward direction with the tether cord being raised to simulate a take-off. The drive vehicle 16 may then be driven about in various directions through use of rudder pedals to simulate the aircraft change of direction while the operator can simultaneously manipulate the pitch and roll attitude to simulate turns and climbs, descents and the like. Operator coordination will then be part of providing the proper aircraft attitudes with the particular maneuver that is being accomplished by the model aircraft. The preformed coiled flexible cords 18 and 20 attached to the drive vehicle 16 and platform 14 supply electric power to the motors contained in drive vehicle 16 and platform 14. The rudder pedals 15 attached to the flight control box 12 control the steerable wheels of drive vehicle 16 and thus its direction as it moves about the upper surface of false ceiling 22 permitting complete freedom of directional movement of models 10.

Figure 5:
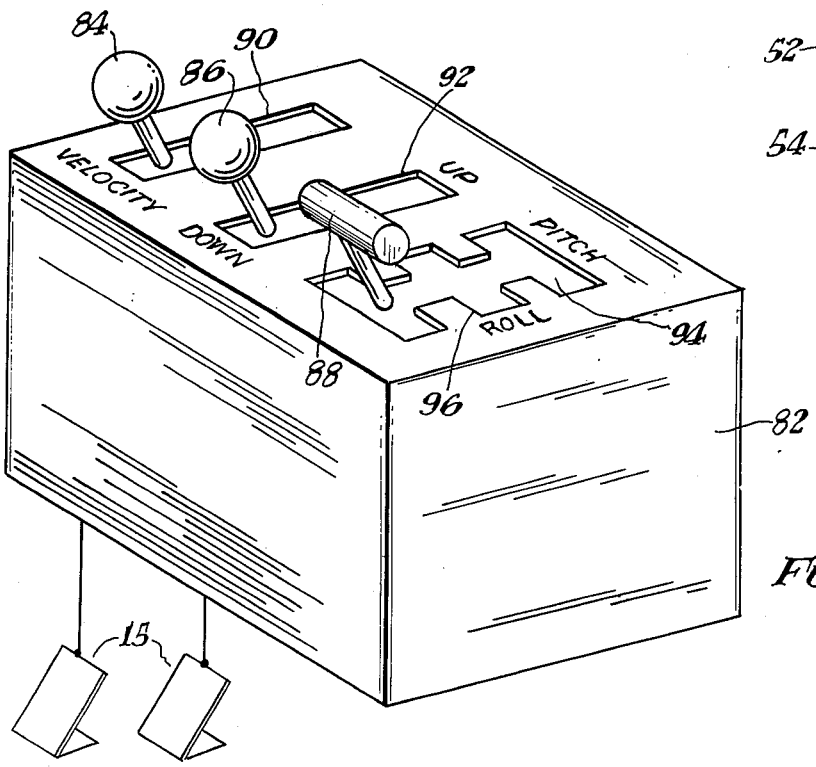
FIG. 5 shows a perspective view of the control box as utilized in the instant invention.

FIG. 5 shows the control box utilized to provide control of the forward motion direction and flight attitude control of the instant invention. The control includes a housing 82 and plurality of electrical current regulators 84, 86 and 88 which are respectively coupled to the various drive motors of the device to provide either a regulated DC or AC power signal to the respective motors which have been discussed above. The rudder pedals 15 are similar current control devices for providing a signal to the motor which steers the wheels on the driving vehicle. The controls 84, 86 and 88 may be structured to simulate aircraft controls such as a throttle and stick and are positioned in slots 90, 92, 94 and 96 for controlling the amount of forward velocity, the altitude and the pitch and roll by movement of the control device within the slots respectively. The motors utilized in the instant invention and the control circuitry utilized in the control box are conventional to provide variable motor speed and direction to the particular motor units.

Figure 6:
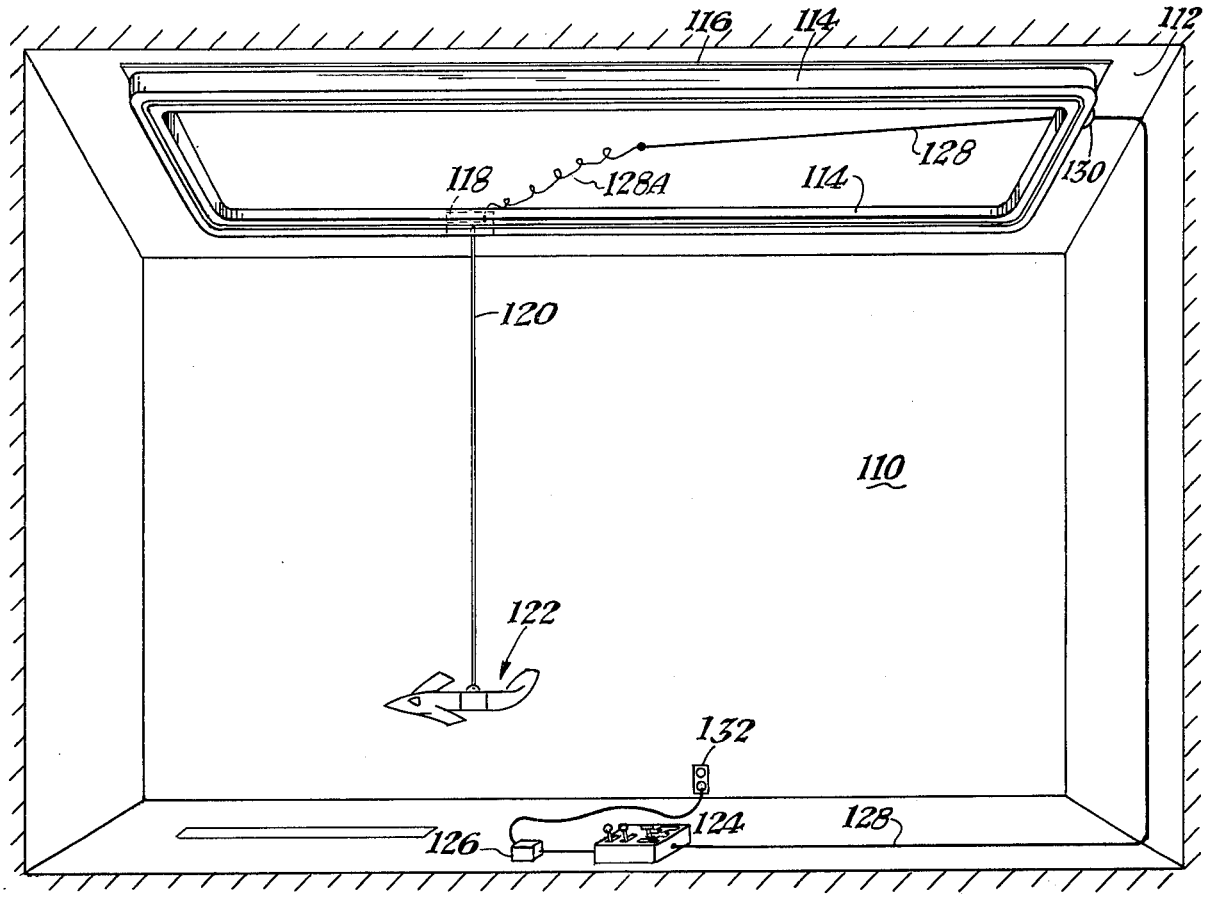
FIG. 6 shows a perspective view of an alternate embodiment of the instant invention.

In an alternate embodiment shown in FIG. 6, the false ceiling is eliminated and a track is suspended from a ceiling 112 the track including a drive vehicle 118 which both drives and supports an aircraft 122 by a tether 120. The room 110 is conventional and may represent a recreation room or playroom where track 114 would be permanently mounted on the ceiling 112. A control box 124 minus rudder pedal directional input commands on this tracked version is connected to a power source 126 which may be a transformer coupled to conventional household power supply 132. The control and power source is connected by conductor 128 which is disposed through track 114 by connector 130 and has a flexible portion anchored near the center of the track 128A coupled to the driving vehicle 118.

Figure 7:
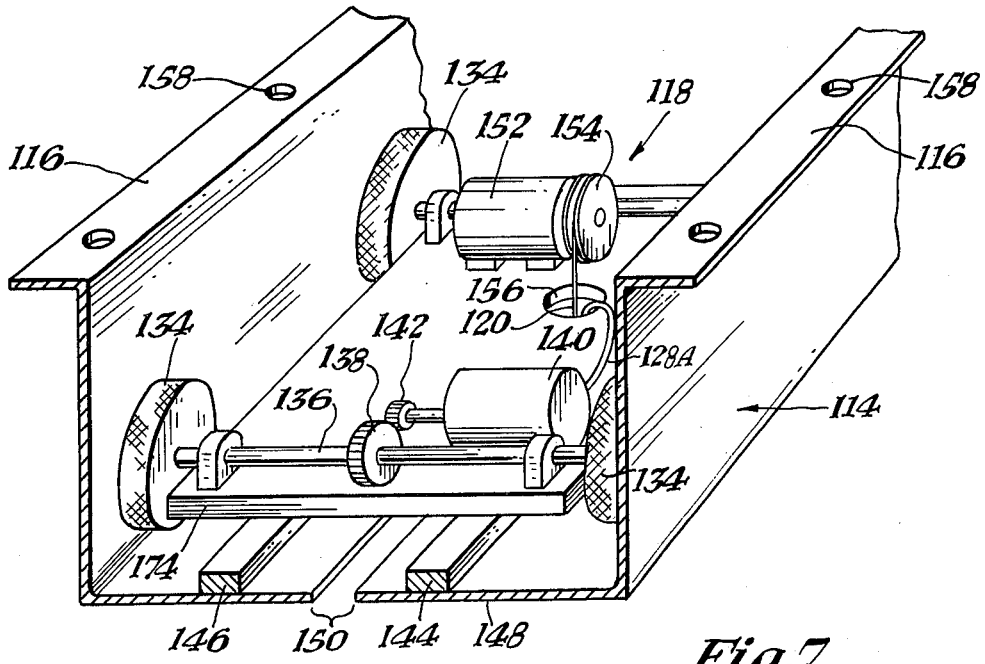
FIG. 7 shows a perspective view partially cut-away of a track and drive mechanism utilized in an alternate embodiment of the instant invention.

The vehicle for the track mounted version as shown in FIG. 7 includes a plurality of wheels 134 connected to a drive motor 140 through axle 136 and gear 142, the entire unit being mounted on platform 174. Tether motor 152 includes a reel 154 with the tether 120 disposed downthrough aperture 156 as is a cord 128A which supplies power to motors 140 and 152 through aperture 156. The track 114 may be mounted on a conventional ceiling with connectors through apertures 158 and substantially a pair of angle plates 116 which are spaced by separation 150 which allows the tether and power cords to be received along. Since in the alternate embodiment, the vehicle rides on a track no control is provided for steering the vehicle which is accomplished by the track plates.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A model aircraft control and propulsion system comprising:

a model aircraft;

means for providing a pathway for moving a vehicle, said means being attachable to a room ceiling;

a vehicle moveably coupled to said ceiling vehicle support means;

tethering means connected to said moveable vehicle and said aircraft;

means for controlling the movement of said vehicle;

power supply connected to said means for controlling movement of said vehicle;

motor means for propelling said vehicle connected to said vehicle and said power means;

means connected to said moveable vehicle for positionably moving said tether vertically to a particular vertical position relative to said ceiling; and means in said aircraft for changing the flight attitude of said aircraft relative to said tethering means.

2. Aircraft control device, as in claim 1, wherein:

said aircraft includes first and second rotatable fuselage portions, a center fuselage portion rotatably coupled to said first and second portions and the means in said aircraft for rotating the moveable portions of said fuselage relative to said center portion.

3. A model aircraft flight control simulator comprising:

a rigid non-magnetically responsive planar member;

a model aircraft, said model aircraft having a fuselage having a rotatable portion;

an electrical power supply;

a first controllable, moveable vehicle moveable about said upper surface of said rigid planar member coupled to said power source, said moveable vehicle having a magnetic field coupling means disposed therein;

a second moveable vehicle mountable beneath said first vehicle and coupled to the lower surface of said rigid planar member, said second vehicle having a means for generating a magnetic field of opposite polarities to said magnetic field of said first vehicle;

a tether connected to said second vehicle and said aircraft;

means connected to said tether and said second vehicle for moving said tether and said aircraft in an upward and downward motion; and a flight control signal means connected to said power source and said second vehicle for controlling the elevation of said tether and the movement and direction of said first vehicle.

4. A model aircraft maneuvering system comprising:

an aircraft body, said body including a fixed center portion and relatively moveable wing and tail sections;

a planar member suspended above the floor of a conventional room;

a drive vehicle supported on the upper surface of said planar surface, said drive vehicle including a permanent magnet;

a moveable platform supported on the lower surface of said planar member, said moveable platform including a permanent magnet for magnetically coupling to said drive vehicle through said planar member;

a tether cord connected to said aircraft body and said moveable platform; and, means connected to said moveable platform and said tether for moving said tether vertically to a particular position for controlling the altitude of said aircraft body.

5. A model aircraft control system, as in claim 4, including:

a roll simulating means connected to said aircraft body for moving the tail and wing sections of said aircraft body relative to a fixed center portion to simulate banking and roll maneuvers of said aircraft body.

6. A model aircraft system, as in claim 4, including:

an aircraft pitch control means connected to said aircraft body for changing said pitch attitude of said aircraft body relative to said tether.

* * * * *